United States Patent [19]

Matsuda

[11] Patent Number: 4,498,316

[45] Date of Patent: Feb. 12, 1985

[54] WARP-KNIT STRINGER TAPE FOR SLIDE FASTENERS

[75] Inventor: Yoshio Matsuda, Nyuzen, Japan

[73] Assignee: Yoshida Kogyo K. K., Tokyo, Japan

[21] Appl. No.: 535,078

[22] Filed: Sep. 28, 1983

[30] Foreign Application Priority Data

Sep. 29, 1982 [JP] Japan ..... 57-147738[U]

[51] Int. Cl.[3] ..... D04B 7/04

[52] U.S. Cl. ..... 66/196; 66/202; 66/193

[58] Field of Search ..... 66/196, 192, 193, 195, 66/190, 202

[56] References Cited

U.S. PATENT DOCUMENTS 3,926,017 12/1975 Matsuda ..... 66/195
3,996,773 12/1976 Matsuda ..... 66/196
4,043,007 8/1977 Heimberger ..... 66/195
4,409,802 10/1983 Matsuda ..... 66/193
4,444,020 4/1984 Matsuda ..... 66/196

*Primary Examiner*—Ronald Feldbaum
*Attorney, Agent, or Firm*—Hill, Van Santen, Steadman & Simpson

[57] ABSTRACT

A warp-knit slide fastener stringer tape suitable for use on knit garment comprises a longitudinally stretchable elongate web portion, and a longitudinally non-stretchable marginal portion extending along one longitudinal edge of the web portion for supporting one coupling element row of a slide fastener and also for being in contact with a slider. The web portion has a double-faced knit structure having a plurality of longitudinal wales on opposite faces, while the marginal portion has a single-faced knit structure having a plurality of longitudinal wales on only one face. The longitudinal wales at the web portion are composed of textured yarns, while the longitudinal wales at the marginal portion are composed of multifilament yarns.

11 Claims, 5 Drawing Figures

WARP-KNIT STRINGER TAPE FOR SLIDE FASTENERS

BACKGROUND OF THE INVENTION

1. Field of the Invention

The present invention relates to a warp-knit stringer tape for slide fasteners suitable for use on knit garments.

2. Prior Art

There is known a variety of warp-knit slide fastener stringer tapes of synthetic fibers, and most of the known warp-knit stringer tapes are made of one and the same kind of synthetic fibers, i.e. multifilament yarns. However, because of poor stretchability and poor softness of multifilament yarns, such prior stringer tapes are substantially rigid and hence are not suitable for use on knit garments which require the stringer tape not only to have a soft and bulky texture, but also to be stretchable, particularly longitudinally thereof. Further, because of the difference in stretchability between the stringer tapes of multifilament yarns and knit garments, the prior stringer tape tends to become wavy or puckered when attached to a knit garment by stitching, thus requiring a well-experienced person to carry out proper attaching of the tape.

SUMMARY OF THE INVENTION

According to the present invention, a warp-knit slide fastener stringer tape comprises a longitudinally stretchable elongate web portion, and a longitudinally non-stretchable marginal portion extending along one longitudinal edge of the web portion for supporting one coupling element row of a slide fastener and also for being in contact with a slider. The web portion has a double-faced knit structure having a plurality of longitudinal wales on opposite faces, while the marginal portion has a single-faced knit structure having a plurality of longitudinal wales on only one face. The longitudinal wales at the web portion are composed of textured yarns, while the longitudinal wales at the marginal portion are composed of multifilament yarns.

It is therefore an object of the invention to provide a warp-knit stringer tape for slide fasteners suitable for use on knit garments.

Another object of the invention is to provide a warp-knit stringer tape for slide fasteners which is soft and longitudinally stretchable in its web portion and hence can be sewn to a knit garment easily and accurately with no development of creases or puckers.

Still another object of the invention is to provide a warp-knit stringer tape which has a fluffy and bulky web portion, giving a softness and a texture like a knit wool fabric.

A further object of the invention is to provide a warp-knit stringer tape which has a longitudinally non-stretchable marginal portion with one face wale-free and thus flat, enabling stable attachment of a row of coupling elements to the marginal portion.

Many other advantages, features and additional objects of the present invention will become manifest to those versed in the art upon making reference to the detailed description and the accompanying drawings in which preferred embodiments incorporating the principles of the present invention are shown by way of illustrative example.

DETAILED DESCRIPTION

Figure 1:
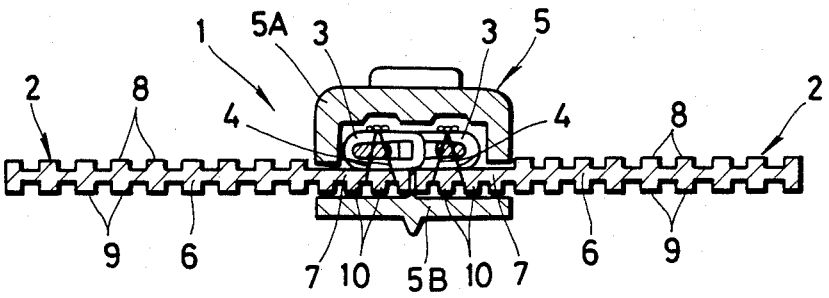
FIG. 1 is a transverse cross-sectional view of a slide fastener including a pair of stringers, each having a warp-knit stringer tape according to the present invention.

FIG. 1 shows a slide fastener 1 comprising a pair of stringers, each including a warp-knit stringer tape 2 supporting on and along one longitudinal edge thereof a row of coupling elements 3 secured to the stringer tape 2 by sewn stitches 4. A slider 5 is mounted on the pair of coupling element rows 3, 3 for movement therealong to close and open the slide fastener 1. The stringer tape 2, includes a longitudinally stretchable web portion 6, and a longitudinally non-stretchable marginal portion 7 extending along one longitudinal edge of the web portion 6.

Figure 2:
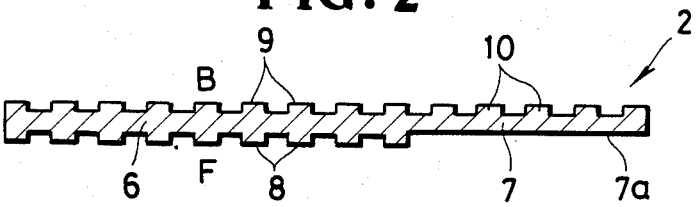
FIG. 2 is an enlarged cross-sectional view of the stringer tape of FIG. 1.

The stringer tape 2 is made on a double needle bar Raschel machine; as shown in FIGS. 1 and 2, the web portion 6 is knit on both front and back needle bars into a double-faced knit structure having a plurality of longitudinal wales 8, 9 on front and back faces, during which time the marginal portion 7 is knit on only a back needle bar into a single-faced knit structure having a plurality of longitudinal wales 10 on only a back face. A front face 7*a* of the marginal portion 7 is devoid of wales and is thus flat for a purpose described below.

Figure 4:
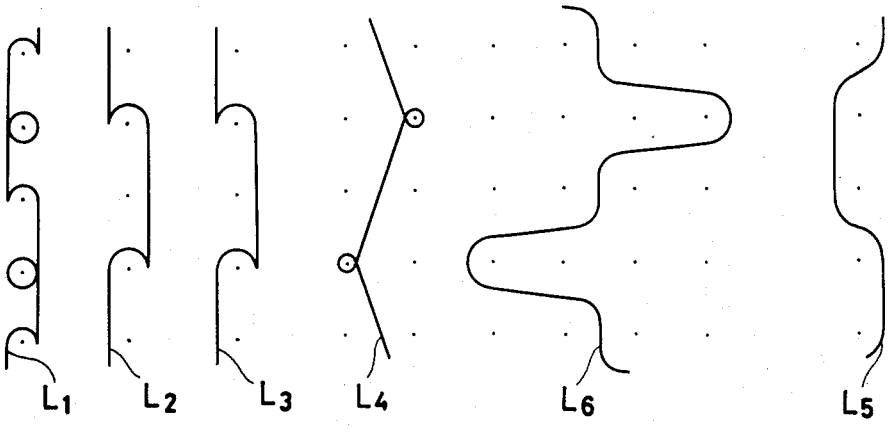
FIG. 4, appearing with FIG. 1, is a point diagram illustrating the knitting patterns of various threads of FIG. 3.
Figure 3:
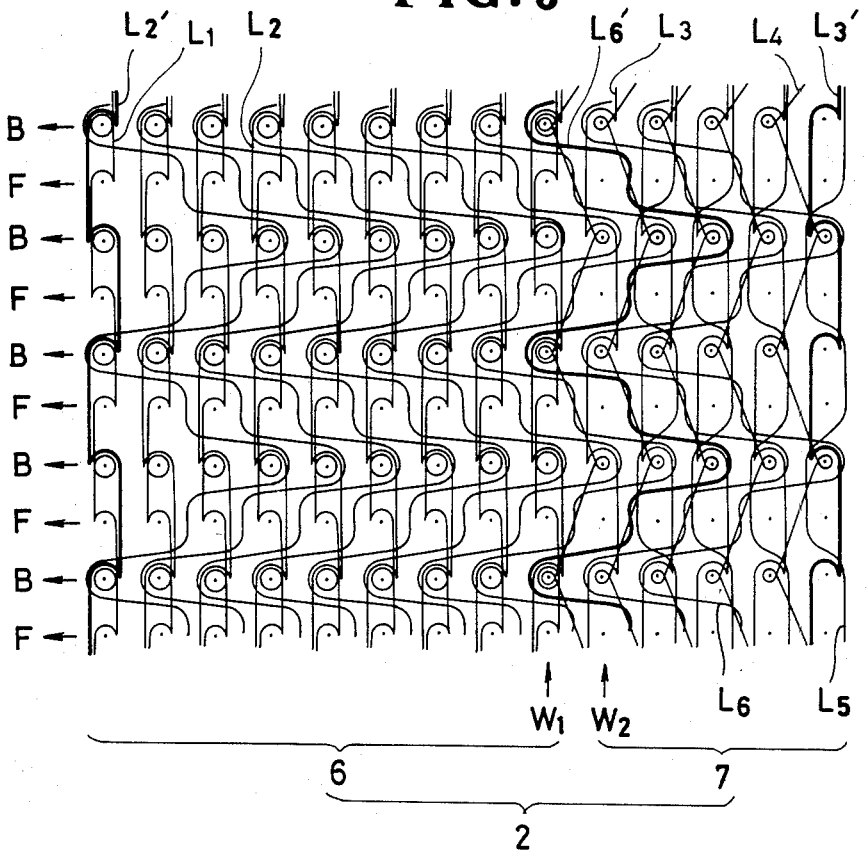
FIG. 3 is a point diagram illustrating a warp-knit fabric structure of the stringer tape of FIG. 2.

As shown in FIGS. 3 and 4, the web portion 6 includes a plurality of threads L1 knit as first chain stitches having a pattern of 2-0/0-2/0-2/2-0, and a plurality of threads L2 knit as second chain stitches having a pattern of 2-2/2-0/0-0/0-2. Each of the threads L1 of the first chain stitches extends longitudinally of a respective one of the wales 8, 9 and has a succession of stitch loops therealong. Likewise, each of the threads L2 of the second chain stitches extends longitudinally of a respective one of the wales 8, 9 and has a succession of stitch loops therealong. The threads L1 and L2 comprise textured yarns. Thus the wales 8, 9 at the web portion 6 are composed of textured yarns, making the web portion 6 to be longitudinally stretchable and also to be soft and bulky.

The marginal portion 7 includes a plurality of threads L3 knit as third chain stitches having a pattern of 2-2/2-0/0-0/0-2, a plurality of threads L4 knit as tricot stitches having a pattern of 2-2/2-4/2-2/2-0, and a plurality of warp threads L5 laid in a pattern of 0-0/0-0/1-1/1-1. Each of the thread L3 of the third chain stitches extends longitudinally of a respective one of the wales 10 and has a succession of stitch loops therealong. Each of the threads L4 of the tricot stitches extends between an adjacent pair of the wales 10 and has a plurality of alternate stitch loops therealong. Each of the inlaid warp threads L5 extends longitudinally of a respective one of the four outer wales 10. The threads L3, L4, L5 comprise multifilament yarns. Thus the wales 10 at the marginal portion 7 are composed of multifilament yarns, making the marginal portion 7 to be longitudinally non-stretchable and also to be small in thickness.

The stringer tape 2 further includes a plurality of weft threads L6 comprising multifilament yarns and laid in the web and marginal portions 6, 7 in a pattern of 4-4/8-8/4-4/0-0. Each of the inlaid weft threads L6 extends across four adjacent ones of the wales 8, 9, 10.

The web portion 6 and the marginal portion 7 are interconnected by the innermost (leftmost in FIG. 3) one of the tricot-stitch threads L3 and also by three of the inlaid weft threads L6 extending across the two confronting wales W1, W2 adjacent to the border between the web and marginal portions 6, 7. Large and strong yarns are used for the outermost thread L2' of the second chain stitches, the outermost thread L3' of the third chain stitches, and one of the inlaid weft threads L6'.

Figure 5:
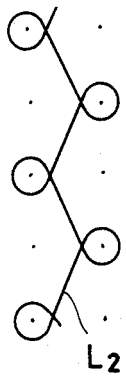
FIG. 5 is a point diagram illustrating a modified knitting pattern of one thread of FIGS. 3 and 4.

Alternatively, the threads L2 may be knitted as tricot stitches having a pattern of 2-4/2-0/2-4/2-0, as shown in FIG. 5.

As shown in FIG. 1, the row of coupling elements 3 is secured to the front wale-free surface *7a* of the marginal portion 7 by the sewn stitches 4 which extend around the coupling elements 3 and through the tape 2 at inter-wale portions.

The row of coupling elements 3 is attached to the marginal portion 7 with adequate stability, partly because the coupling-element-supporting face *7a* of the marginal portion 7 is wale-free and thus flat, and partly because the longitudinal wales 10 of the marginal portion 7 are composed of multifilament yarns and hence are longitudinally non-stretchable. Further, with such thin and not bulky marginal portion 7, the slider 5 is smoothly movable along the opposed rows of coupling elements 3, 3 to close and open the slide fastener 1, during which time the slider's upper wing 5A is engageable with the wale-free front face *7a* of the marginal portion 7, and the slider's lower wing 5B is engageable with the waled back face of the marginal portion 7.

Since the longitudinal wales 8, 9 of the web portion 6 is composed of textured yarns, the web portion 6 has not only an adequate degree of longitudinal stretchability, but also a soft, fluffy and bulky texture like a knit wool fabric. Having this soft and bulky web portion 6, the stringer tape 2 can be sewn to a knit garment easily and accurately with no developing of creases or puckers.

Although various minor modifications may be suggested by those versed in the art, it should be understood that I wish to embody within the scope of the patent warranted hereon, all such embodiments as reasonably and properly come within the scope of my contribution to the art.

What is claimed is:

1. A stringer tape for a slide fastener having a pair of rows of coupling elements and a slider threaded thereon, comprising:

(a) an elongate warp-knit fabric including a longitudinally stretchable elongate web portion, and a longitudinally non-stretchable marginal portion extending along one longitudinal edge of said web portion for supporting one coupling element row of the slide fastener and also for being in contact with the slider;

(b) said web portion having a double-faced knit structure having a plurality of longitudinal wales on opposite faces thereof, said marginal portion having a single-faced knit structure having a plurality of longitudinal wales on only one face thereof; and (c) said longitudinal wales at said web portion being composed of textured yarns, said longitudinal wales at said marginal portion being composed of multifilament yarns.

2. A slide fastener stringer tape according to claim 1, said warp-knit fabric including:

(a) a first set of the textured yarns knit as first chain stitches extending longitudinally of the wales in said web portion;

(b) a second set of the textured yarns knit as second chain stitches extending longitudinally of the wales in said web portion;

(c) a first set of the multifilament yarns knit as third chain stitches extending longitudinally of the wales in said marginal portion;

(d) a second set of the multifilament yarns knit as tricot stitches extending between the wales in said marginal portion;

(e) a third set of the multifilament yarns laid in as warp threads extending longitudinally of the wales in said marginal portion; and (f) a plurality of weft threads comprising multifilament yarns extending across the longitudinal wales in said web and marginal portions.

3. A slide fastener stringer tape according to claim 1, said warp-knit fabric including:

(a) a first set of the textured yarns knit as first chain stitches extending longitudinally of the wales in said web portion;

(b) a second set of the textured yarns knit as tricot stitches extending between the wales in said web portion;

(c) a first set of the multifilament yarns knit as third chain stitches extending longitudinally of the wales in said marginal portion;

(d) a second set of the multifilament yarns knit as tricot stitches extending between the wales in said marginal portion;

(e) a third set of the multifilament yarns laid in as warp threads extending longitudinally of the wales in said marginal portion; and (f) a plurality of weft threads comprising multifilament yarns extending across the longitudinal wales in said web and marginal portions.

4. A slide fastener stringer tape according to claim 2, said first chain stitches having a pattern of 2-0/0-2/0-2/2-0.

5. A slide fastener stringer tape according to claim 2, said second chain stitches having a pattern of 2-2/2-0/0-0/0-2.

6. A slide fastener stringer tape according to claim 2, said third chain stitches having a pattern of 2-2/2-0/0-0/0-2.

7. A slide fastener stringer tape according to claim 2, said tricot stitches having a knitting pattern of 2-2/2-4/2-2/2-0.

8. A slide fastener stringer tape according to claim 2, said warp threads being laid in a pattern of 0-0/0-0/1-1/1-1.

9. A slide fastener stringer tape according to claim 2, said weft threads being laid in a pattern of 4-4/8-8/4-4/0-0.

10. A slide fastener stringer tape according to claim 3, said tricot stitches having a pattern of 2-4/2-0/2-4/2-0.

11. A slide fastener stringer tape according to claim 2, an outermost one of the textured yarns of said second chain stitches, an outermost one of the multifilament yarns of said third chain stitches, and one of said inlaid weft threads of the multifilament yarns being large and strong, said one weft thread extending across the wales around a border between said web and marginal portions.

* * * * *